US009574529B2

(12) United States Patent
Nam et al.

(10) Patent No.: US 9,574,529 B2
(45) Date of Patent: Feb. 21, 2017

(54) COOLING SYSTEM FOR ENGINE ROOM

(71) Applicant: Hyundai Motor Company, Seoul (KR)

(72) Inventors: Jongwoo Nam, Whasung-Si (KR); Hanshin Chung, Whasung-Si (KR); Joonho Lee, Whasung-Si (KR); Hyun Cho, Whasung-Si (KR)

(73) Assignee: Hyundai Motor Company, Seoul (KR)

( * ) Notice: Subject to any disclaimer, the term of this patent is extended or adjusted under 35 U.S.C. 154(b) by 147 days.

(21) Appl. No.: 14/557,006

(22) Filed: Dec. 1, 2014

(65) Prior Publication Data

US 2015/0330284 A1 Nov. 19, 2015

(30) Foreign Application Priority Data

May 13, 2014 (KR) ..... 10-2014-0057017

(51) Int. Cl.
*F01P 1/00* (2006.01)
*F02M 35/10* (2006.01)
*F02M 35/16* (2006.01)

(52) U.S. Cl.
CPC ..... *F02M 35/161* (2013.01); *F01P 1/00* (2013.01); *F01P 2001/005* (2013.01)

(58) Field of Classification Search
CPC ..... F02M 35/161; F02M 31/20; F02M 2700/4359; F01P 1/00; F01P 1/06; F01P 7/02; F01P 7/026; F01P 2001/005; B60K 11/00; B60K 11/06; B60K 11/08; B60H 1/00664; B60H 2001/00721; B60H 2001/00085; B60H 2001/00092
USPC ..... 123/41.04, 41.05, 41.29, 41.31, 41.56, 123/41.58, 41.59, 41.62, 184.21, 123/184.38, 184.31; 60/320, 321
See application file for complete search history.

(56) References Cited

U.S. PATENT DOCUMENTS 2,585,083 A * 2/1952 Bouvy ..... F01P 5/06 123/41.62
3,186,394 A * 6/1965 Ramun ..... F01N 5/00 123/522
8,181,728 B2 * 5/2012 Hartland ..... B60K 11/08 180/68.1

FOREIGN PATENT DOCUMENTS

JP 2002097952 A * 4/2002 ..... F01P 1/06
KR 10-2005-0044025 A 5/2005
KR 10-2007-0109491 A 11/2007
KR 10-2011-0055276 A 5/2011
KR 10-2011-0080037 A 7/2011
KR 10-2013-0063663 A 6/2013

* cited by examiner

*Primary Examiner* — Grant Moubry
(74) *Attorney, Agent, or Firm* — Morgan, Lewis & Bockius LLP

(57) ABSTRACT

An engine room cooling system may include an encapsulation covering an intake manifold and an exhaust manifold of an engine of a vehicle, a main duct guiding traveling wind flowing into the vehicle to a side of the encapsulation, an encapsulation intake duct branched from the main duct and formed toward the intake manifold within the encapsulation, an encapsulation exhaust duct branched from the main duct and formed toward the exhaust manifold within the encapsulation, and an intake duct valve disposed adjacent to the encapsulation intake duct and controlling air flow from the main duct to the encapsulation intake duct or to the encapsulation exhaust duct.

7 Claims, 6 Drawing Sheets

COOLING SYSTEM FOR ENGINE ROOM

CROSS-REFERENCE TO RELATED APPLICATION

The present application claims priority to and the benefit of Korean Patent Application No. 10-2014-0057017 filed on May 13, 2014, the entire contents of which is incorporated herein for all purposes by this reference.

BACKGROUND OF THE INVENTION

Field of the Invention

The present invention relates to a vehicle engine cooling system and, more particularly, to a vehicle engine cooling system capable of enhancing cooling performance of a vehicle with simple structure.

Description of Related Art

A vehicle is structurally divided into a vehicle body and a chassis.

Among them, the vehicle body is a part including an engine room and forming an appearance of a vehicle, and, in general, an engine, a transmission, a cooling device, various accessory elements, and the like, are installed in the engine room.

The engine room is a space in which an engine heated to have a high temperature during running is installed, and thus, in order to effectively cool the engine and prevent heat damage, optimization of heat flow with respect to an engine room layout needs to be essentially considered at the stage of vehicle development.

Vehicle manufacturers have made efforts to improve cooling performance through various studies such as analysis of an influence of heat flow factors on a layout within an engine room, or the like.

Namely, optimization of heat flow is promoted by improving factors affecting heat flow within an engine room, namely, by increasing a span of left and right side members and a horizontal distance of a strut housing, simplifying and optimally disposing components of an engine room and accessory elements, tilting a cooling fan, optimizing an air guide structure, and the like, through which a certain level of improvement, such as cooling and prevention of heat damage, and the like, is achieved.

However, simple optimization of heat flow with respect to an engine room layout can improve partial performance such as engine cooling and prevention of heat damage but it cannot obtain a sufficient improvement in terms of an overall engineering performance of an engine room, namely, in a comprehensive aspect such as fuel efficiency, emission, acoustics, aerodynamics, and the like.

Also, the related art obtains desired effects of improving cooling performance and efficiency through optimization of a structure and disposition of a cooling module (tilting of a cooling fan, or the like), application of an active air flap, optimization of a disposition and structure of an air guide, and the like, but improvement effects and range thereof in a comprehensive aspect of an engine room are limited and, actually, there is a limitation in distributing heat flow to the right position due to complicated engine room flow characteristics.

Also, in general, an engine cover covering an upper portion of an engine is installed in an engine room and an under cover is installed in a lower portion of the engine room in relation to a reduction of noise of a vehicle, but, these are merely related to improvement and optimization of structures or improvement of materials in terms of a reduction in noise, discharge of heat, and the like, with respect to the members, but without a consideration of fuel efficiency, aerodynamics, and the like.

An optimization structure for an engine room heat management advanced by optimizing heat flow of an engine room in terms of cooling is required.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a vehicle engine cooling system having advantages of enhancing cooling performance of a vehicle with simple structure.

An engine room cooling system according to exemplary embodiments of the present invention may include an encapsulation covering an intake manifold and an exhaust manifold of an engine of a vehicle, a main duct guiding traveling wind flowing into the vehicle to a side of the encapsulation, an encapsulation intake duct branched from the main duct and formed toward the intake manifold within the encapsulation, an encapsulation exhaust duct branched from the main duct and formed toward the exhaust manifold within the encapsulation and an intake duct valve disposed adjacent to the encapsulation intake duct and controlling air flow from the main duct to the encapsulation intake duct or to the encapsulation exhaust duct.

The encapsulation intake duct may be disposed to forward of the vehicle comparing to the encapsulation exhaust duct.

The engine may be a single intake I type engine and the main duct, the encapsulation intake duct and the encapsulation exhaust duct may be formed to one side of the engine.

The engine may be a single intake V type engine and the main duct, the encapsulation intake duct and the encapsulation exhaust duct may be formed to one side of the engine, wherein the system may further include a main duct and an encapsulation exhaust duct which is branched from the main duct and formed toward the exhaust manifold within the encapsulation at the opposite side of the engine.

The engine may be a dual intake V type engine, and the main duct, the encapsulation intake duct and the encapsulation exhaust duct may be formed as a pair and disposed to both side of the engine.

The system may further include a coolant temperature sensor sensing coolant temperature within the engine and outputting a corresponding signal, a temperature sensor sensing temperature within the encapsulation and outputting a corresponding signal, a speed sensor sensing speed of the vehicle and outputting a corresponding signal and a control portion receiving operation state information of the vehicle including the outputting signals of the coolant temperature sensor, the temperature sensor and the speed sensor, determining whether cooling of the exhaust manifold is required or not, and controlling operations of the intake duct valve for the air to flow toward the encapsulation exhaust duct when cooling of the exhaust manifold is required.

The encapsulation intake duct may be connected with an air filter.

An engine room cooling system according to an exemplary embodiment of the present invention may enhance cooling performance of a vehicle with simple structure.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
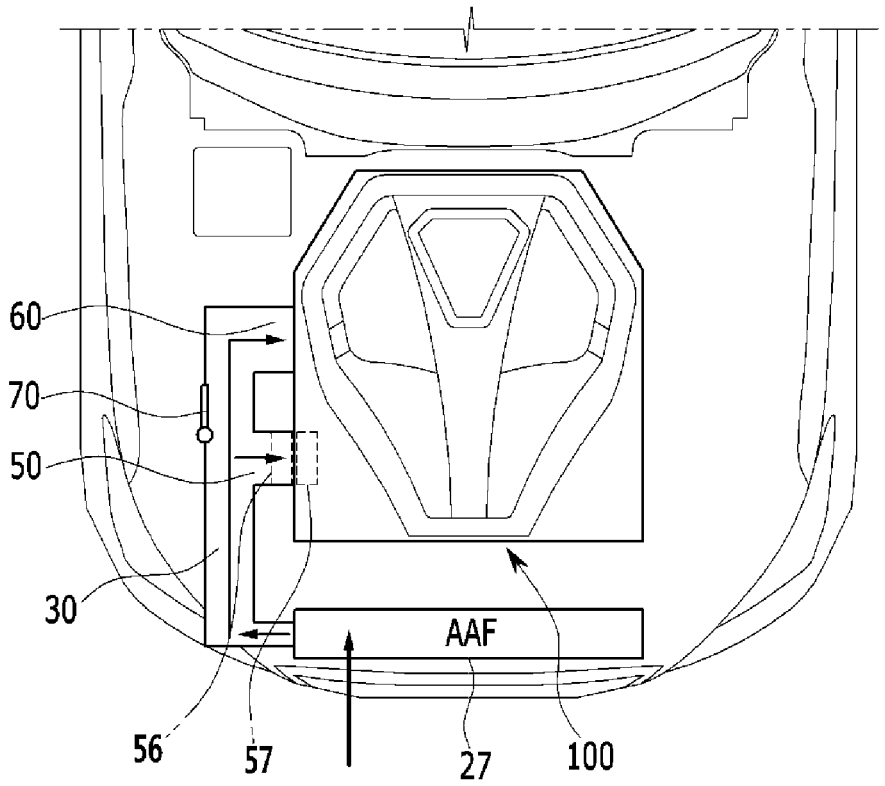
FIG. 1 and FIG. 2 are drawings showing an engine room cooling system according to various exemplary embodiments of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the following detailed description, only certain exemplary embodiments of the present invention have been shown and described, simply by way of illustration.

As those skilled in the art would realize, the described embodiments may be modified in various different ways, all without departing from the spirit or scope of the present invention Throughout the specification, like numbers refer to like elements.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification, unless explicitly described to the contrary, the word "comprise" and variations such as "comprises" or "comprising", will be understood to imply the inclusion of stated elements but not the exclusion of any other elements.

An exemplary embodiment of the present invention will hereinafter be described in detail with reference to the accompanying drawings.

Figure 6:
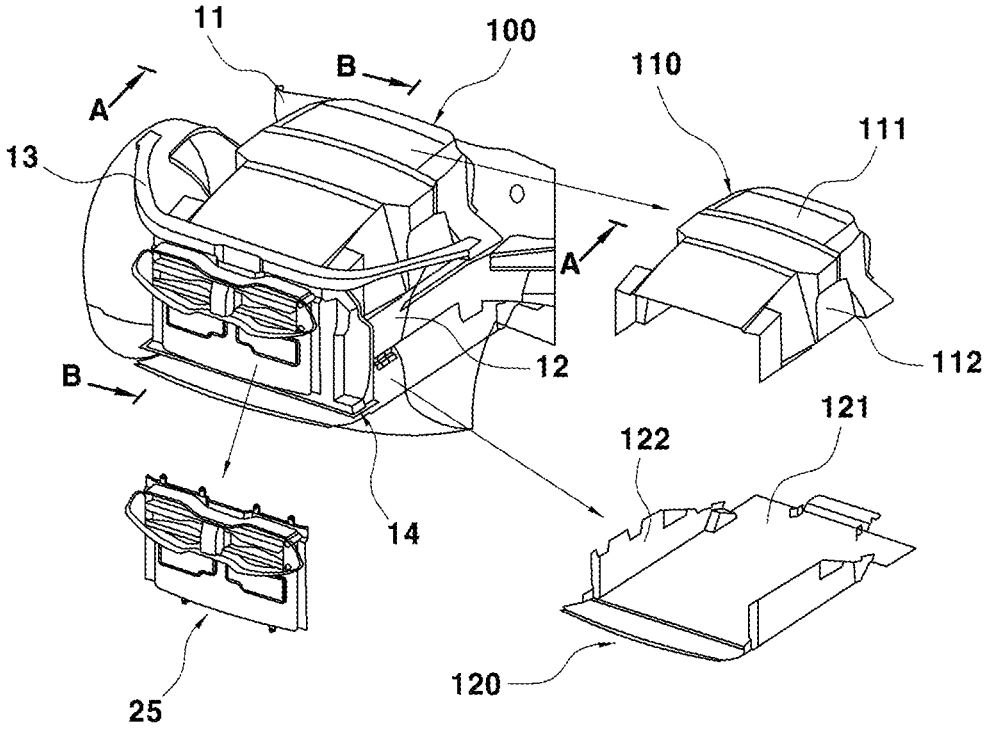
FIG. 6 is a drawing showing an encapsulation which may be apple to an engine room cooling system according to various exemplary embodiments of the present invention.

FIG. 6 is a drawing showing an encapsulation which may be applied to an engine room cooling system according to various exemplary embodiments of the present invention.

As shown in FIG. 6, an encapsulation 100 includes an engine room encapsulation member 110 disposed to an upper portion of an engine room and an under body encapsulation member 120 disposed to a lower portion of the engine room.

The engine room encapsulation member 110 is an upper shielding element mounted to upper portion of the engine room, covers the engine and a transmission and shields spaces among a front end module 14 disposed to a front part of the vehicle body, a dash panel 11 disposed between the engine room and a cabin and both side members 12.

The engine room encapsulation member 110 includes an upper cover 111 covering upper portion of the engine room and side covers 112 covering side portions of the engine room and the upper cover 111 and the side covers 112 are may be formed integrally.

Also, the engine room encapsulation member 110 may include a rear cover covering a rear part of the engine room, and a front part of the engine room encapsulation member 110 is opened to introduce air.

The engine room encapsulation member 110 may be mounted to a part of the vehicle body within the engine room or a mounting element fixed to the vehicle body, for example a front part of the upper cover 111 may be mounted to a carrier 13 of the front end module 14, the side covers 112 may be mounted to sides portion of the vehicle body within the engine room and the side members 12, and the rear cover may be mounted to the dash panel 11.

The engine room encapsulation member 110, which is mounted as described above, may be manufactured by forming synthetic resin to have a predetermined thickness in order to reduce the weight, and preferably, may be made of a complex material made by reinforcing synthetic resin a reinforcing material, such as glass fiber, for example, PP-GF30 (polypropylene glass fiber).

In FIG. 6, reference numeral 25 indicates a cooling duct disposed at the front end of the car body and an active air flap (referring to 27 in FIG. 1 to FIG. 4) that opens/closes the front inlet of the engine encapsulation structure 100 in response to a control signal of a control unit is disposed in the cooling duct 25.

The underbody encapsulation member 120 may also be fixed to the vehicle body in the engine room or a fixture attached to the car body, in which, for example, sides covers 122 and a lower cover 121 may be formed integrally.

Figure 2:
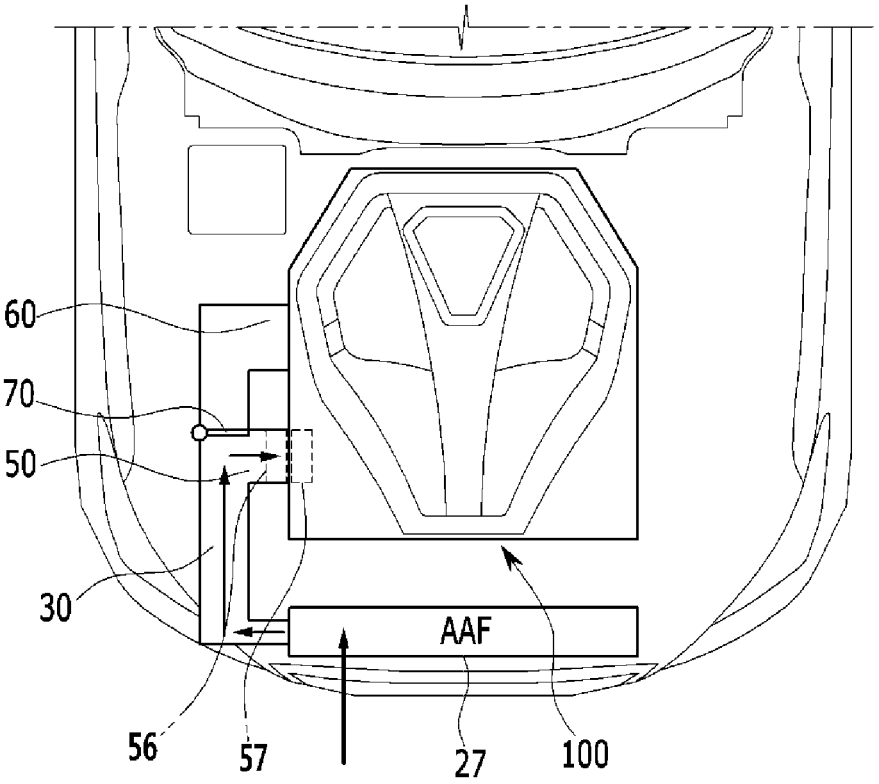

FIG. 1 and FIG. 2 are drawings showing an engine room cooling system according to various exemplary embodiments of the present invention.

Referring to FIG. 1, FIG. 2 and FIG. 6, the engine room cooling system according to various exemplary embodiments of the present invention includes an encapsulation 100 covering an intake manifold and an exhaust manifold of an engine of a vehicle.

Structures and functions of the intake manifold and exhaust manifold equipped to the engine are obvious to person skilled in the art, and thus detailed description will be omitted.

The engine room cooling system includes a main duct 30 guiding traveling wind flowing, namely, outside air being supplied to a radiator into the vehicle to a side of the encapsulation 100, an encapsulation intake duct 50 branched from the main duct 30 and formed toward the intake manifold within the encapsulation 100, an encapsulation exhaust duct 60 branched from the main duct 30 and formed toward the exhaust manifold within the encapsulation 100 and an intake duct valve 70 disposed adjacent to the encapsulation intake duct 50 and controlling air flow from the main duct 30 to the encapsulation intake duct 50 or to the encapsulation exhaust duct 60.

The encapsulation intake duct 50 is disposed to forward of the vehicle comparing to the encapsulation exhaust duct 60. That is, since generally, the intake manifold is disposed toward front side of the vehicle, the encapsulation intake duct 50 is disposed in front of the encapsulation exhaust duct 60.

The engine may be a single intake I type engine and the main duct 30, the encapsulation intake duct 50 and the encapsulation exhaust duct 60 are formed to one side of the engine.

Since the single intake I type engine is equipped with one intake manifold and one exhaust manifold, thus the encapsulation intake duct 50 and the encapsulation exhaust duct 60 are disposed to one side of the engine to introduce air to the intake manifold and the exhaust manifold.

The air introduced to the encapsulation intake duct 50 is used for combustion, and the air introduced to the encapsulation exhaust duct 60 is used for cooling the exhaust duct.

The encapsulation intake duct 50 may be connected to an air filter 56 or 57 and the air filtered in the air filter 56 or 57 is supplied to the engine.

The air filter may be disposed within the encapsulation intake duct 50 referring numeral 56 or may be disposed within the encapsulation 100 referring numeral 57.

Referring to FIG. 1, in high speed and high load condition, a control portion (200, referring to FIG. 5) controls the intake duct valve 70 to be opened and air is supplied to the intake manifold and the exhaust manifold and used combustion and cooling. So that fuel consumption in high speed state may be improved.

The intake duct valve 70 may be a valve which is operated in accordance with electric signals.

In this case, the air may pass the active air flap 27 or bypass the active air flap 27. Also, the air may be introduced to the encapsulation 100 according to the operation of the active air flap 27.

Referring to FIG. 2, in middle or low speed and high load condition, a control portion 200 controls the intake duct valve 70 to be closed and the air is supplied only to the intake manifold.

Figure 3:
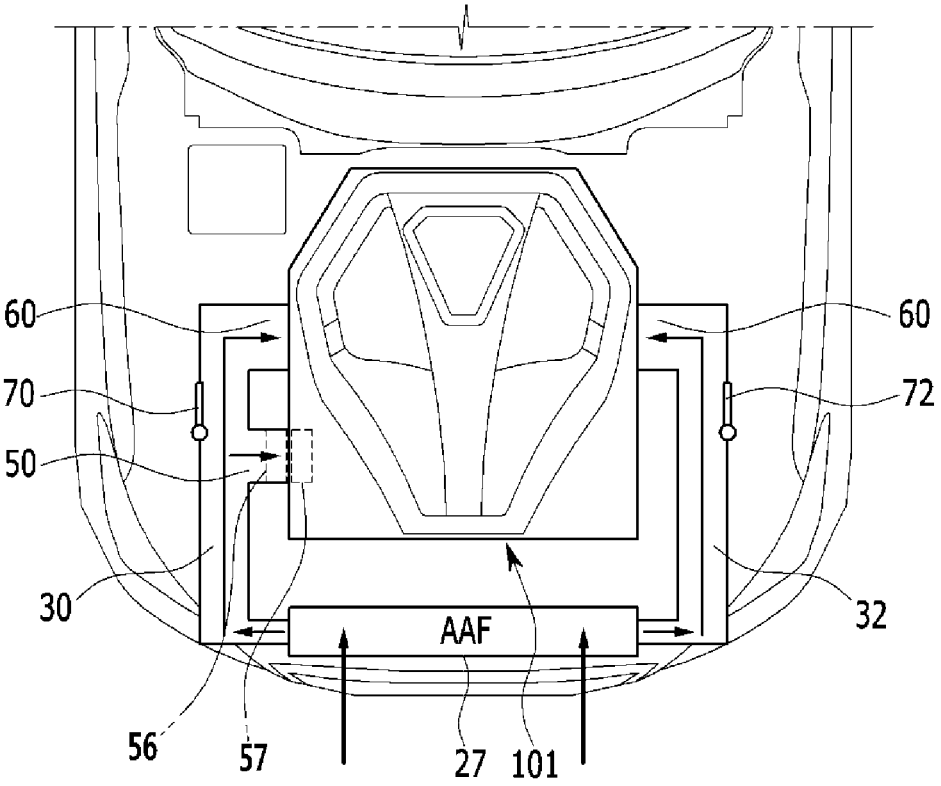
FIG. 3 and FIG. 4 are drawings showing an engine room cooling system according to various exemplary embodiments of the present invention.

Referring to FIG. 3, the engine may be a single intake V type engine and the main duct 30, the encapsulation intake duct 50 and the encapsulation exhaust duct 60 are formed to one side of the engine (left side of the engine in drawing), and the system further includes a main duct 32 and an encapsulation exhaust duct 60 which is branched from the main duct 30 and formed toward the exhaust manifold within an encapsulation 101 at the opposite side of the engine.

The single intake V type engine is equipped with one intake manifold and two exhaust manifold. A structure and an operation are obvious to a person skilled in the art, and thus detailed description will be omitted.

And two intake duct valves 70 and 72 are disposed for introducing the air in the main ducts 30 and 32 to the encapsulation intake ducts 50 and 52.

Operations of the intake duct valves 70 and 72 are the same as described about the intake duct valve 70 referring to FIG. 1 and FIG. 2, and thus repeated description will be omitted.

Figure 4:
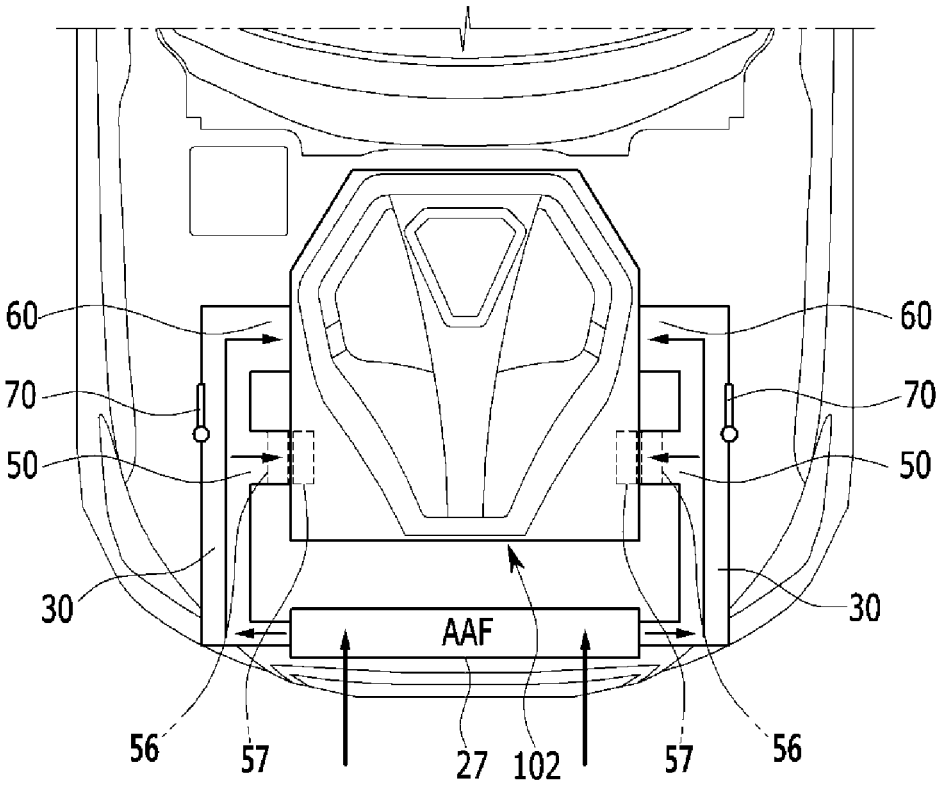

Referring to FIG. 4, the engine may be a dual intake V type engine, and the main ducts 30, the encapsulation intake ducts 50 and the encapsulation exhaust ducts 60 are formed as a pair and disposed to both side of an encapsulation 102.

The dual intake V type engine is equipped with two intake manifold and two exhaust manifold. A structure and an operation are obvious to a person skilled in the art, and thus detailed description will be omitted.

And two intake duct valves 70 are disposed for introducing the air in the main ducts 30 to the encapsulation intake ducts 50. Operations of the intake duct valves 70 are the same as described about the intake duct valve 70 referring to FIG. 1 and FIG. 2, and thus repeated description will be omitted.

Figure 5:
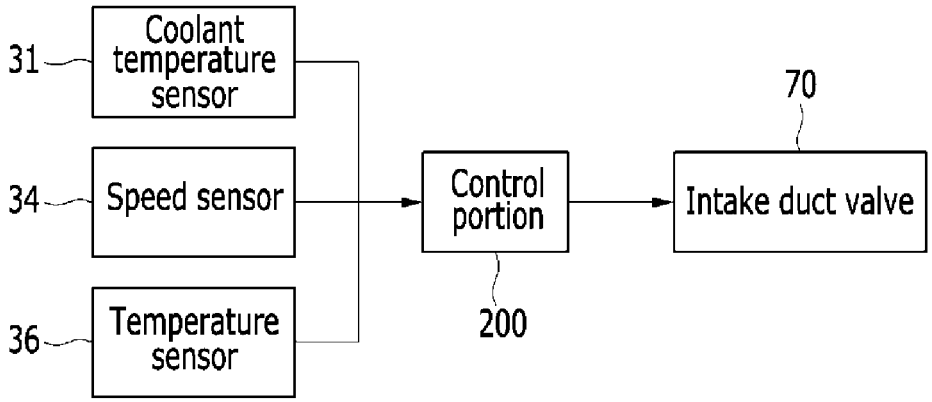
FIG. 5 is a block diagram showing an engine room cooling system according to various exemplary embodiments of the present invention.

FIG. 5 is a block diagram showing an engine room cooling system according to various exemplary embodiments of the present invention.

Referring to FIG. 5, the engine room cooling system includes a coolant temperature sensor 31 sensing coolant temperature within the engine and outputting a corresponding signal, a temperature sensor 36 sensing temperature within the encapsulation 100 and outputting a corresponding signal, a speed sensor 34 sensing speed of the vehicle and outputting a corresponding signal and the control portion 200 receiving operation state information of the vehicle including the outputting signals of the coolant temperature sensor 31, the temperature sensor 36 and the speed sensor 34, determining whether cooling of the exhaust manifold is required or not, and controlling operations of the intake duct valve 70 for the air to flow toward the encapsulation exhaust duct when cooling of the exhaust manifold is required.

According to the operation of the intake duct valve 70 controlled by the control portion 200, the air may be used for cooling the exhaust manifold as well as for combustion. So operation time of a cooling fan may be reduced and fuel consumption may be improved.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine room cooling system comprising:

an encapsulation covering an intake manifold and an exhaust manifold of an engine of a vehicle;

a first main duct guiding traveling wind flowing into the vehicle to a side of the encapsulation;

an encapsulation intake duct branched from the first main duct and formed toward the intake manifold within the encapsulation;

an encapsulation exhaust duct branched from the first main duct and formed toward the exhaust manifold within the encapsulation; and an intake duct valve disposed adjacent to the encapsulation intake duct and controlling air flow from the first main duct to the encapsulation intake duct or to the encapsulation exhaust duct.

2. The system of claim 1, wherein the encapsulation intake duct is disposed further forward of the vehicle as compared to the encapsulation exhaust duct.

3. The system of claim 1, wherein the engine is a single intake I type engine; and the first main duct, the encapsulation intake duct and the encapsulation exhaust duct are formed to one side of the engine.

4. The system of claim 1, wherein the engine is a single intake V type engine, wherein the first main duct, the encapsulation intake duct and the encapsulation exhaust duct are formed to one side of the engine, and wherein the system further comprises a second main duct and a second encapsulation exhaust duct which is branched from the first main duct and formed toward the exhaust manifold within the encapsulation at a side of the engine opposite to one side of the engine.

5. The system of claim 1, wherein the engine is a dual intake V type engine, and wherein the first main duct, the encapsulation intake duct and the encapsulation exhaust duct are formed as a pair and disposed to both sides of the engine.

6. The system of claim 1, further comprising:

a coolant temperature sensor sensing coolant temperature within the engine and outputting a corresponding signal;

a temperature sensor sensing temperature within the encapsulation and outputting a corresponding signal;

a speed sensor sensing speed of the vehicle and outputting a corresponding signal; and a control portion receiving operation state information of the vehicle including outputting signals of the coolant temperature sensor, the temperature sensor and the speed sensor, determining whether cooling of the exhaust manifold is required or not, and controlling operations of the intake duct valve for the traveling wind to flow toward the encapsulation exhaust duct when cooling of the exhaust manifold is required.

7. The system of claim 1, wherein the encapsulation intake duct is connected with an air filter.

* * * * *